US012565836B2

(12) United States Patent
Dubost et al.

(10) Patent No.: US 12,565,836 B2
(45) Date of Patent: Mar. 3, 2026

(54) SYSTEMS AND METHODS FOR PERFORMING DOWNHOLE FORMATION TESTING OPERATIONS

(71) Applicant: Schlumberger Technology Corporation, Sugar Land, TX (US)

(72) Inventors: Francois-Xavier Dubost, Paris (FR); Ashers Partouche, Sugar Land, TX (US); Hua Chen, Sugar Land, TX (US); Bertrand Theuveny, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/778,296

(22) Filed: Jul. 19, 2024

(65) Prior Publication Data

US 2025/0027411 A1 Jan. 23, 2025

Related U.S. Application Data

(60) Provisional application No. 63/514,705, filed on Jul. 20, 2023.

(51) Int. Cl.

| | |
|---|---|
| ***E21B 49/08*** | (2006.01) |
| ***E21B 47/10*** | (2012.01) |
| *E21B 33/12* | (2006.01) |
| *E21B 43/11* | (2006.01) |

(52) U.S. Cl.

CPC ..... *E21B 49/087* (2013.01); *E21B 47/10* (2013.01); *E21B 33/12* (2013.01); *E21B 43/11* (2013.01)

(58) Field of Classification Search

CPC ..... E21B 49/087; E21B 49/081; E21B 49/10; E21B 47/10; E21B 33/12; E21B 43/11

See application file for complete search history.

(56) References Cited

U.S. PATENT DOCUMENTS

| | | | | |
|---|---|---|---|---|
| 4,535,843 | A * | 8/1985 | Jageler | E21B 33/1243 73/152.28 |
| 4,635,717 | A * | 1/1987 | Jageler | E21B 49/10 73/152.55 |
| 5,353,875 | A * | 10/1994 | Schultz | E21B 43/116 175/4.52 |
| 2002/0178804 | A1* | 12/2002 | Manke | E21B 49/088 73/152.55 |
| 2011/0017448 | A1* | 1/2011 | Pipchuk | E21B 49/00 166/241.5 |
| 2021/0324736 | A1* | 10/2021 | Edmundson | E21B 49/082 |
| 2023/0383649 | A1* | 11/2023 | Valero | E21B 49/088 |

* cited by examiner

*Primary Examiner* — Yong-Suk (Philip) Ro
(74) *Attorney, Agent, or Firm* — Kyle R. Miller

(57) ABSTRACT

Systems and methods of the present disclosure provide systems and methods for performing downhole formation testing operations. Certain methods include deploying a downhole toolstring of a downhole formation testing system to a downhole location within a wellbore extending through a subterranean formation, wherein the downhole toolstring includes a single packer positioned near a lower end of the downhole toolstring; setting the single packer within the wellbore to isolate one or more zones of interest of the subterranean formation in a lower portion of the wellbore below the single packer from an upper portion of the wellbore above the single packer; and, after setting the single packer within the wellbore, using the downhole toolstring to perform downhole formation testing on one or more fluids received from the one or more zones of interest by the downhole toolstring.

16 Claims, 4 Drawing Sheets

SYSTEMS AND METHODS FOR PERFORMING DOWNHOLE FORMATION TESTING OPERATIONS

CROSS-REFERENCE

This application claims the benefit of U.S. Provisional Application No. 63/514,705, entitled "SYSTEMS AND METHODS FOR PERFORMING DOWNHOLE FORMATION TESTING OPERATIONS," filed Jul. 20, 2023, the disclosure of which is hereby incorporated herein by reference.

FIELD OF THE INVENTION

The present disclosure relates to systems and methods for performing downhole formation testing operations.

BACKGROUND INFORMATION

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Downhole toolstrings are configured to perform various downhole operations including, but not limited to, deep transient testing, fluid sampling, fluid analysis, and so forth. The operations often require multiple packers connected with a downhole toolstring to isolate a zone of interest.

SUMMARY

A summary of certain embodiments described herein is set forth below. It should be understood that these aspects are presented merely to provide the reader with a brief summary of these certain embodiments and that these aspects are not intended to limit the scope of this disclosure.

The embodiments described herein generally relate to systems and methods for performing downhole formation testing operations. Certain benefits of the downhole formation testing operations include isolating a single zone and flowing all fluids below it to allow performance of formation testing over relatively large intervals that cannot usually be covered by a straddle packer system. In addition, isolating with a bottom packer and adding other packers above enables the testing of several zones simultaneously and measurement for an overall flowrate, and using individual pressure responses to understand the contribution of each tested intervals. Furthermore, commingling these zones and performing downhole fluid analysis of the commingled fluids enables testing for fluid compatibilities and properties of the mix of fluids. The downhole toolstring described herein includes downhole fluid analyzers such that the fluid streams of a single zone may be determined with a first instrument of the downhole toolstring, the fluid streams of another zone may be determined with a second instrument of the downhole toolstring, and then the commingled fluid streams from both zones may be analyzed.

Certain embodiments of the present disclosure include a method that includes deploying a downhole toolstring of a downhole formation testing system to a downhole location within a wellbore extending through a subterranean formation. The downhole toolstring includes a single packer positioned near a lower end of the downhole toolstring. The method also includes setting the single packer within the wellbore to isolate one or more zones of interest of the subterranean formation in a lower portion of the wellbore below the single packer from an upper portion of the wellbore above the single packer. The method further includes, after setting the single packer within the wellbore, using the downhole toolstring to perform downhole formation testing on one or more fluids received from the one or more zones of interest by the downhole toolstring.

In addition, certain embodiments of the present disclosure include a downhole formation testing system having a downhole toolstring configured to perform downhole formation testing on one or more fluids received from one or more zones of interest of a subterranean formation. The downhole toolstring includes a single packer positioned near a lower end of the downhole toolstring. The single packer is configured to be set within a wellbore extending through the subterranean formation to isolate the one or more zones of interest of the subterranean formation in a lower portion of the wellbore below the single packer from an upper portion of the wellbore above the single packer.

In addition, certain embodiments of the present disclosure include a method that includes deploying and setting a first downhole barrier of a downhole formation testing system within a wellbore at a first downhole location extending through a subterranean formation. The method also includes deploying and setting a second downhole barrier of the downhole formation testing system within the wellbore at a second downhole location above the first downhole barrier. The second downhole barrier includes a bore extending axially therethrough to enable fluids to flow therethrough, an upper sensor positioned on an upper side of the second downhole barrier, and a lower sensor positioned on a lower side of the second downhole barrier. The method further includes deploying a downhole toolstring of a downhole formation testing system to a third downhole location within the wellbore above the first and second downhole barriers. The downhole toolstring includes a single packer positioned near a lower end of the downhole toolstring. The method also includes setting the single packer within the wellbore to isolate first and second zones of interest of the subterranean formation in a lower portion of the wellbore below the single packer from an upper portion of the wellbore above the single packer. The method further includes, after setting the single packer within the wellbore: using the downhole toolstring to perform downhole formation testing on a first fluid received from a first zone of interest by the downhole toolstring in a first interval of the wellbore between the first downhole barrier and the second downhole barrier based at least in part on the flow and/or volume rates of the first and second fluids detected by the first and second sensors of the second downhole barrier; and using the downhole toolstring to perform downhole formation testing on a second fluid received from a second zone of interest by the downhole toolstring in a second interval of the wellbore between the second downhole barrier and the single packer based at least in part on the flow and/or volume rates of the first and second fluids detected by the first and second sensors of the second downhole barrier.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
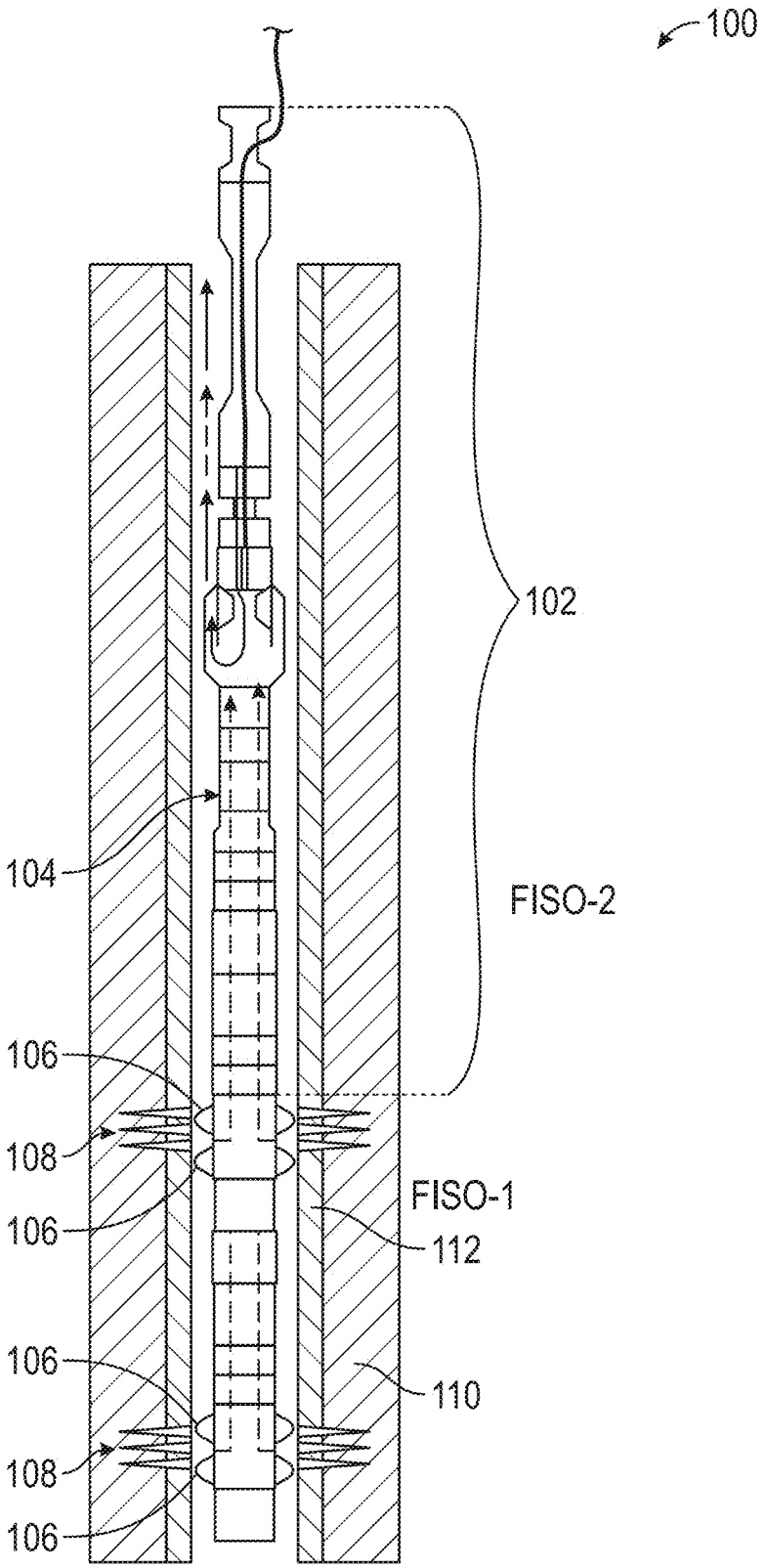
FIG. 1 illustrates a downhole formation testing system configured to perform a downhole formation testing operation using a downhole toolstring, in accordance with embodiments of the present disclosure.

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "continuous", "continuously", or "continually" are intended to describe operations that are performed without any significant interruption. For example, as used herein, control commands may be transmitted to certain equipment every five minutes, every minute, every 30 seconds, every 15 seconds, every 10 seconds, every 5 seconds, or even more often, such that operating parameters of the equipment may be adjusted without any significant interruption to the closed-loop control of the equipment. In addition, as used herein, the terms "automatic", "automated", "autonomous", and so forth, are intended to describe operations that are performed are caused to be performed, for example, by a computing system (i.e., solely by the computing system, without human intervention). Indeed, it will be appreciated that the control system described herein may be configured to perform any and all of the control functions described herein automatically.

In addition, as used herein, the term "substantially similar" may be used to describe values that are different by only a relatively small degree relative to each other. For example, two values that are substantially similar may be values that are within 10% of each other, within 5% of each other, within 3% of each other, within 2% of each other, within 1% of each other, or even within a smaller threshold range, such as within 0.5% of each other or within 0.1% of each other.

Similarly, as used herein, the term "substantially parallel" may be used to define downhole tools, formation layers, and so forth, that have longitudinal axes that are parallel with each other, only deviating from true parallel by a few degrees of each other. For example, a downhole tool that is substantially parallel with a formation layer may be a downhole tool that traverses the formation layer parallel to a boundary of the formation layer, only deviating from true parallel relative to the boundary of the formation layer by less than 5 degrees, less than 3 degrees, less than 2 degrees, less than 1 degree, or even less.

The embodiments described herein include systems and methods for performing downhole formation testing operations. FIG. 1 illustrates a downhole formation testing system 100 configured to perform a downhole formation testing operation using a downhole toolstring 102. As illustrated, in certain embodiments, the downhole toolstring 102 may include one or more packers 106, and the downhole toolstring 102 may be positioned in the wellbore 104 such that one or more packers 106 are adjacent zones of interest 108, such as perforated zones, as illustrated, or open hole zones, fractured zones, or similar zones of a subterranean formation 110 through which the wellbore 104 extends. In certain embodiments, once the zones of interest 108 are perforated, the downhole toolstring 102 may be conveyed into the wellbore 104 using any suitable means of conveyance including wireline, drill pipes, or any other suitable conveyance means. The downhole toolstring 102 may then be lowered to a desired location where the one or more packers 106 are located adjacent the ends of the zones of interest 108. The one or more packers 106 may then be set, thereby isolating the zones of interest 108 via the one or more packers 106. It should be noted that, while the downhole toolstring 102 may be deployed via wireline, drill pipe, or any other suitable conveyance means, because of the need for relatively high flowrates in commingle zones, drill pipe may be needed in certain situations.

The downhole toolstring 102 may be used to perform downhole testing operations. The downhole testing operations can include sampling, downhole fluid analysis, transient testing, and so forth. For example, during sampling, pump modules that are part of the downhole toolstring 102 may be operated to draw fluid into a downhole fluid analyzer of the downhole toolstring 102 from the subterranean formation 110. After completion of the downhole testing operation, the one or more packers 106 may be deflated and the downhole toolstring 102 may be brought back to surface. As such, the downhole toolstring 102 may include various flow control devices configured to control the flow of sample fluids into and through the downhole toolstring 102 to enable the downhole toolstring 102 to perform deep transient testing, fluid sampling, fluid analysis, and so forth, as described in greater detail herein.

In certain embodiments, the sequence of operation of the system 100 illustrated in FIG. 1 may begin with the zones of interest 108 being cased and perforated, after which the downhole toolstring 102 may be positioned with sets of dual packers 106 straddling respective zones of interest 108. In certain embodiments, the interval of perforations may be extended a few meters (e.g., defined based on interval spacers available). Once each set of dual packers 106 are positioned to straddle respective zones of interest 108, the packers 106 may be inflated against the casing 112 to hold the downhole toolstring 102 in place, and each zone of interest 108 may be tested individually and the fluids in each zone of interest 108 (e.g., FISO-1 and FISO-2) may be identified by their characteristics using the downhole toolstring 102. In addition, in certain embodiments, the pressures of each zone of interest 108 (e.g., in the interval between the respective dual packers 106) may be measured by the downhole toolstring 102 individually. Both zones of interest 108 may then produce hydrocarbons together using dedicated downhole fluid analyzers of the downhole toolstring 102. The upper FISO (i.e., FISO-2) may then be experiencing the contribution of the mix. In certain embodiments, individual contributions may be back allocated based on fluid analysis performed by the downhole toolstring 102, as well as based on inlet pressures of the fluids.

Figure 2:
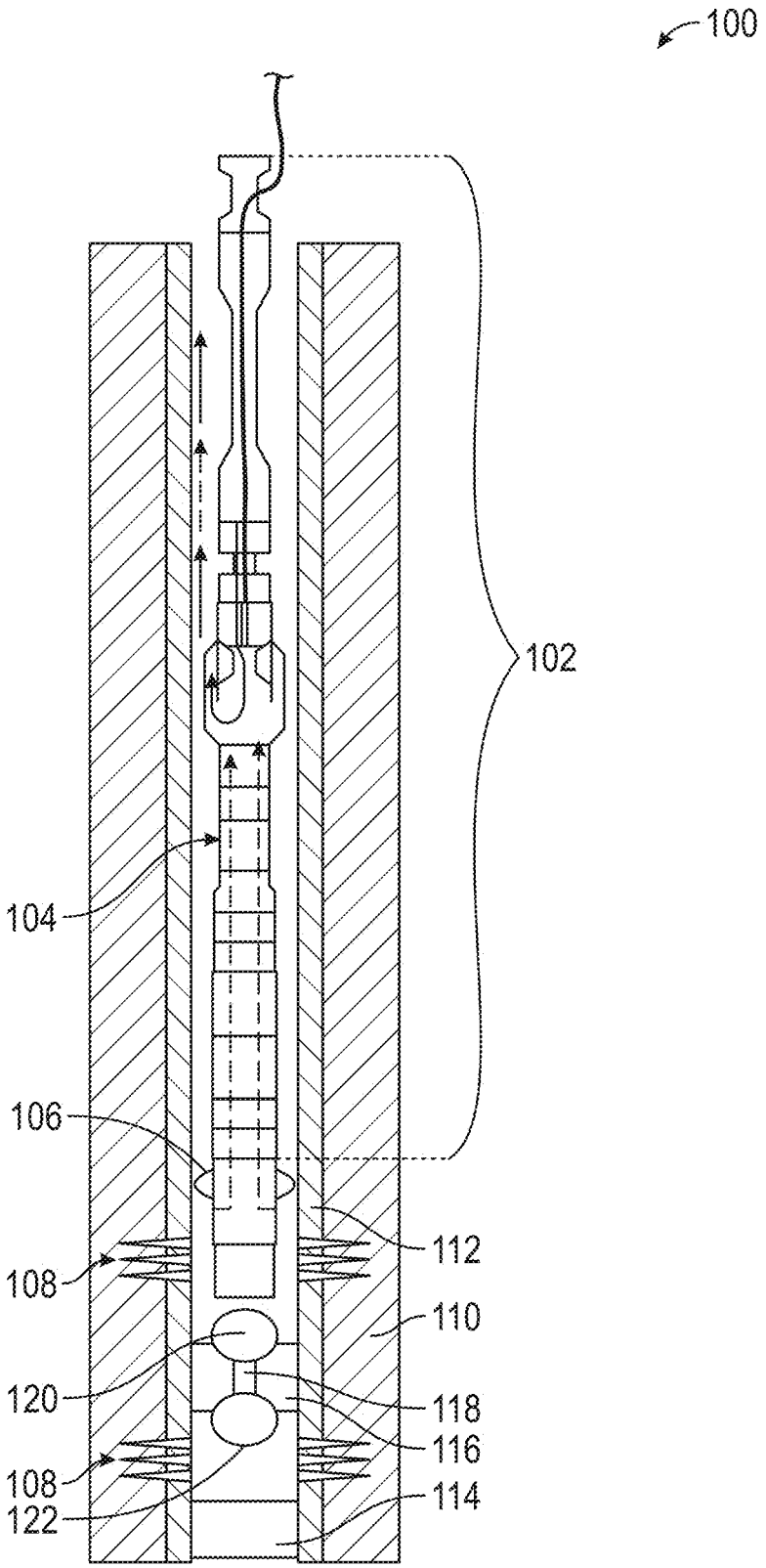
FIG. 2 illustrates another downhole formation testing system configured to perform a downhole formation testing operation using a downhole toolstring, in accordance with embodiments of the present disclosure.

FIG. 2 illustrates an alternate embodiment of the downhole formation testing system 100 of FIG. 1, wherein the downhole formation testing system 100 includes a single packer 106 disposed near a bottom of the downhole toolstring 102 for sealing differential pressure. In the embodiment illustrated in FIG. 2, multiple zones of interest 108 are still perforated and tested by the downhole toolstring 102. In particular, the single packer 106 is located above the multiple zones of interest 108 and a retrievable bridge plug (or other downhole barrier) 114 is located below the multiple zones of interest 108 (e.g., where the retrievable bridge plug 114 is set at its location within the casing 112 prior to the single packer 106 being inflated against the casing 114).

In certain embodiments, the sequence of operation of the downhole formation testing system 100 illustrated in FIG. 2 may begin with the zones of interest 108 being cased and perforated, after which the retrievable bridge plug 114 may be set within the casing 112 just below the perforations of the zones of interest 108. As also illustrated in FIG. 2, in certain embodiments, a second (i.e., additional) retrievable bridge plug 116 having an open bore 118 (e.g., venturi) and upper and lower sensors 120, 122 above and below the venturi 118, respectively, may be positioned between the perforations of the zones of interest 108. Once the retrievable bridge plugs 114, 116 are set in place with respect to the casing 112, the downhole toolstring 102 may be positioned above the upper zone of interest 108, and the single packer 106 may be set to isolate the interval between the single packer 106 and the intermediate retrievable bridge plug 116. Fluid may then be drawn into the well between the single packer 106 and the bottom retrievable bridge plug 114, pumped out of the interval via the downhole toolstring 102, and circulated to the surface by the downhole toolstring 102. In certain embodiments, the upper and lower sensors 120, 122 enable the downhole toolstring 102 to determine volumes and/or flow rates of the fluids flowing into the interval from the upper and lower zones of interest 108.

Although illustrated in FIG. 2 as including one additional bridge plug 116 (e.g., in addition to the lower retrievable bridge plug 114), in other embodiments, multiple additional retrievable bridge plugs 116 may be deployed between the lower retrievable bridge plug 114 and the single packer 106. In such embodiments, individual pressure responses (e.g., via the upper and lower sensors 120, 122) may be measured to simultaneously determine flow rate contributions of each respective interval and as well as the overall flowrate. In addition, commingling these zones and performing downhole fluid analysis of the commingled fluids enables testing for fluid compatibilities and properties of the mix of fluids.

It should also be noted that, in certain embodiments, other packers may be deployed with respect to the downhole toolstring 102 (e.g., above the packer 106 illustrated in FIG. 2). However, the single packer 106 illustrated in FIG. 2 is used to isolate the zones of interest 108 between the single packer 106 (e.g., lower packer) and the lower retrievable bridge plug 114. In addition, although illustrated in FIG. 2 as including a single isolated series of zones of interest 108, in other embodiments, multiple series of zones of interest 108 may be isolated in a similar manner, for example, in a scenario having sidetracks from the main wellbore 104.

In a particular embodiment, a second packer may be deployed with an open bore inside and pressure gauges deployed above and below to measure individual flow rates of a zone of interest 108 below while commingled flow of both combined. With such measurements, the flowrate across the second packer (and so the flowrate of the bottom zone) may be determined, and the individual flowrate contributions may be deduced based on the total flowrate from the flow system, which is known. Such embodiments, would require retrieval of the second packer and it associated gauges, which could be memory pressure gauges that store the data or permanent gauges that could be interrogated after a test. Alternatively, again, in certain embodiments, that data may be transmitted via wireless telemetry.

In addition, in certain embodiments, at least some of (if not all) of the retrievable bridge plugs 114, 116 may be instrumented, and data from the retrievable bridge plugs 114, 116 may be wirelessly transmitted to a receiver in the downhole toolstring 102 to acquire real-time data that may be transmitted to a surface control system and/or processed in the downhole toolstring 102. In addition, in certain embodiments, the downhole toolstring 102 may include a transmitter for wirelessly transmitting control commands to the instrumented retrievable bridge plugs 114, 116 to control other downhole tools (e.g., such as formation samplers) that are deployed in the wellbore 104 below the lower retrievable bridge plug 114.

Figure 3:
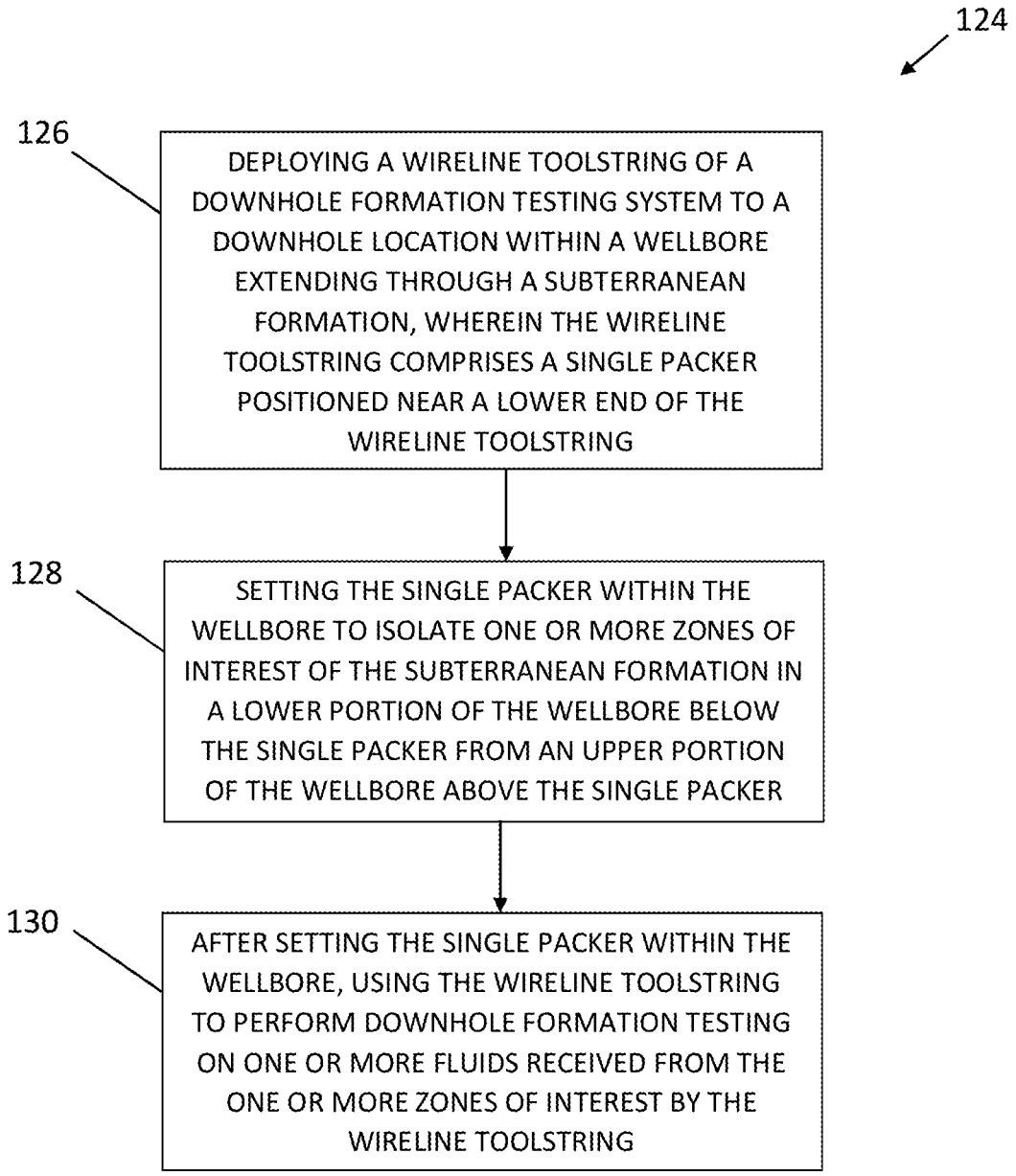
FIG. 3 is a flow diagram of a method of operating the downhole formation testing system of FIG. 2, in accordance with embodiments of the present disclosure.

FIG. 3 is a flow diagram of a method 124 of operating the downhole formation testing system 100 of FIG. 2. As illustrated, in certain embodiments, the method 124 may include deploying a downhole toolstring 102 of a downhole formation testing system 100 to a downhole location within a wellbore 104 extending through a subterranean formation 110, wherein the downhole toolstring 102 includes a single packer 106 positioned near a lower end of the downhole toolstring 102 (step 126). In addition, in certain embodiments, the method 124 may include setting the single packer 106 within the wellbore 104 to isolate one or more zones of interest 108 of the subterranean formation 110 in a lower portion of the wellbore 104 below the single packer 106 from an upper portion of the wellbore 104 above the single packer (step 128). In addition, in certain embodiments, the method 124 may include, after setting the single packer 106 within the wellbore 104, using the downhole toolstring 102 to perform downhole formation testing on one or more fluids received from the one or more zones of interest 108 by the downhole toolstring 102 (step 130). In addition, in certain embodiments, the method 124 may include casing and perforating the one or more zones of interest 108 prior to deploying and setting the single packer 106 within the wellbore 104.

In addition, in certain embodiments, the method 124 may include deploying and setting a first downhole barrier (e.g., retrievable bridge plug) 114 of the downhole formation testing system 100 within the wellbore 104 at a downhole location below the downhole toolstring 102 and the single packer 106 prior to setting the single packer 106 within the wellbore 104. In addition, in certain embodiments, the method 124 may include deploying and setting a second downhole barrier (e.g., retrievable bridge plug) 116 of the downhole formation testing system 100 within the wellbore 104 at a second downhole location above the first downhole barrier 114 and below the downhole toolstring 102 and the single packer 106 prior to setting the single packer 106 within the wellbore 104.

In addition, in certain embodiments, the method 124 may include, after setting the single packer within the wellbore: using the downhole toolstring 102 to perform downhole formation testing on a first fluid received from a first zone of interest 108 by the downhole toolstring 102 in a first interval of the wellbore 104 between the first downhole barrier 114 and the second downhole barrier 116; and using the downhole toolstring 102 to perform downhole formation testing on a second fluid received from a second zone of interest 108 by the downhole toolstring 102 in a second interval of the wellbore 104 between the second downhole barrier 116 and the single packer 106. In addition, in certain embodiments, the second downhole barrier 116 may include a bore 118 extending axially therethrough to enable flow of the first and second fluids between the first and second intervals of the wellbore 104. In addition, in certain embodiments, the method 124 may include determining, using one or more sensors 120, 122 of the second downhole barrier 116, flow and/or volume rates of the first and second fluids; and using the downhole toolstring 102 to perform downhole formation testing on the first and second fluids based at least in part on the flow and/or volume rates of the first and second fluids. In addition, in certain embodiments, the one or more sensors 120, 122 may include an upper sensor 120 positioned on an upper side of the second downhole barrier 116; and a lower sensor 122 positioned on a lower side of the second downhole barrier 116.

Figure 4:
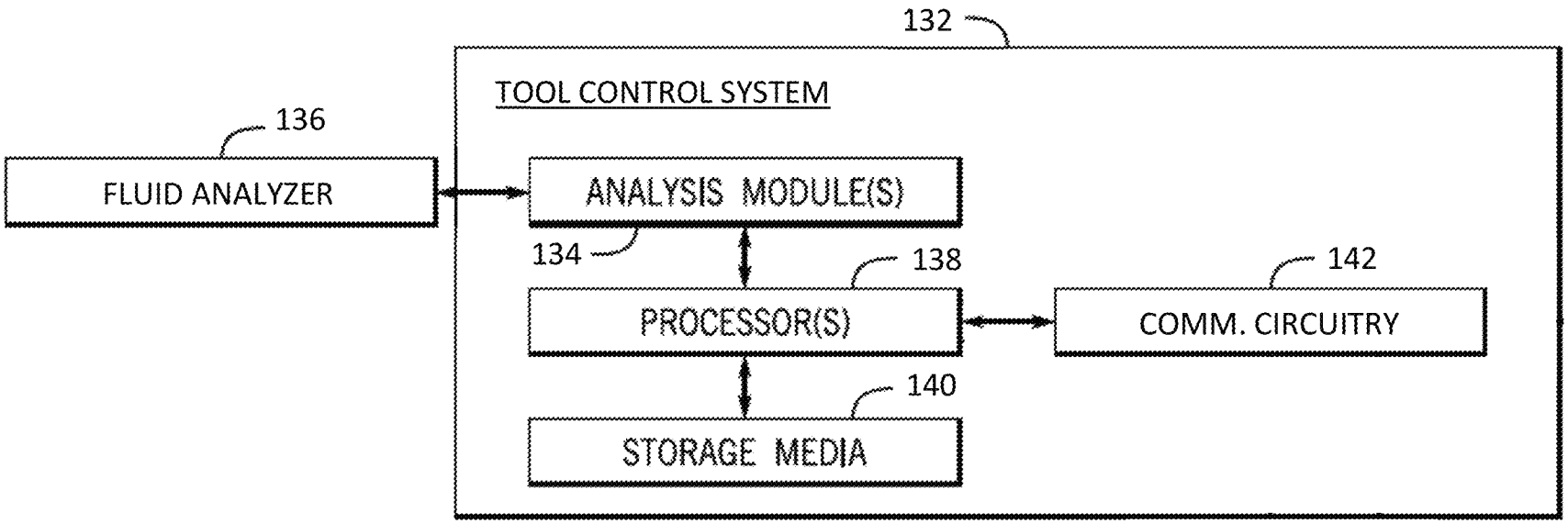
FIG. 4 is a schematic diagram of various components of the downhole toolstring that may enable the downhole toolstring to perform various downhole formation testing operations, in accordance with embodiments of the present disclosure.

As described in greater detail herein, the downhole toolstring 102 may be configured to perform various downhole formation testing operations on fluids received from the zones of interest 108 of the subterranean formation 110. FIG. 4 is a schematic diagram of various components of a tool control system 132 of the downhole toolstring 102 that may enable the downhole toolstring 102 to perform the various downhole formation testing operations described herein. For example, in certain embodiments, the tool control system 132 may include one or more fluid analysis modules 134 (e.g., a program of processor executable instructions and associated data) that may be configured to perform various functions of the embodiments described herein including, but not limited to, analyzing fluids that are received by the downhole toolstring 102 via a downhole fluid analyzer 136 of the downhole toolstring 102. In general, the downhole fluid analyzer 136 is configured to deliver controlled flow rates of the system and the components upstream of pumps. In certain embodiments, to perform these various functions, a fluid analysis module 134 executes on one or more processors 138 of the tool control system 132, which may be connected to one or more storage media 140 of the tool control system 132. Indeed, in certain embodiments, the one or more fluid analysis modules 134 may be stored in the one or more storage media 140.

In certain embodiments, the one or more processors 138 may include a microprocessor, a microcontroller, a processor module or subsystem, a programmable integrated circuit, a programmable gate array, a digital signal processor (DSP), or another control or computing device. In certain embodiments, the one or more storage media 140 may be implemented as one or more non-transitory computer-readable or machine-readable storage media. In addition, in certain embodiments, the one or more storage media 140 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; or other types of storage devices. Such computer-readable or machine-readable storage medium or media are considered to be part of an article (or article of manufacture), which may refer to any manufactured single component or multiple components. In addition, in certain embodiments, the processor(s) 138 may be connected to communication circuitry 142 of the tool control system 132 to allow the tool control system 132 to communicate with a surface control system, among other control systems. In certain embodiments, the communication circuitry 142 may include wireless receivers and transmitter configured to enable wireless transmissions from the tool control system 132 to a surface control system, to enable receipt of data from the retrievable bridge plugs 114, 116 described herein, to transmit control commands to the retrievable bridge plugs 114, 116 described herein, and so forth.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A method, comprising:

deploying a downhole toolstring of a downhole formation testing system to a downhole location within a wellbore extending through a subterranean formation, wherein the downhole toolstring comprises a single packer positioned near a lower end of the downhole toolstring;

prior to setting the single packer within the wellbore, deploying and setting a first downhole barrier of the downhole formation testing system within the wellbore at a first downhole location below the downhole toolstring and the single packer; and deploying and setting a second downhole barrier of the downhole formation testing system within the wellbore at a second downhole location above the first downhole barrier and below the downhole toolstring and the single packer;

setting the single packer within the wellbore to isolate one or more zones of interest of the subterranean formation in a lower portion of the wellbore below the single packer from an upper portion of the wellbore above the single packer; and after setting the single packer within the wellbore, using the downhole toolstring to perform downhole formation testing on one or more fluids received from the one or more zones of interest by the downhole toolstring.

2. The method of claim 1, wherein the first downhole barrier comprises a retrievable bridge plug.

3. The method of claim 1, comprising, after setting the single packer within the wellbore:

using the downhole toolstring to perform downhole formation testing on a first fluid received from a first zone of interest by the downhole toolstring in a first interval of the wellbore between the first downhole barrier and the second downhole barrier; and using the downhole toolstring to perform downhole formation testing on a second fluid received from a second zone of interest by the downhole toolstring in a second interval of the wellbore between the second downhole barrier and the single packer.

4. The method of claim 3, wherein the second downhole barrier comprises a bore extending axially therethrough to enable flow of the first and second fluids between the first and second intervals of the wellbore.

5. The method of claim 4, comprising:

determining, using one or more sensors of the second downhole barrier, at least one of flow or volume rates of the first and second fluids; and using the downhole toolstring to perform downhole formation testing on the first and second fluids based at least in part on the at least one of flow or volume rates of the first and second fluids.

6. The method of claim 5, wherein the one or more sensors comprise:

an upper sensor positioned on an upper side of the second downhole barrier; and a lower sensor positioned on a lower side of the second downhole barrier.

7. The method of claim 1, wherein the first and second downhole barriers comprise retrievable bridge plugs.

8. The method of claim 1, comprising casing and perforating the one or more zones of interest prior to deploying and setting the single packer within the wellbore.

9. A downhole formation testing system, comprising:

a downhole toolstring configured to perform downhole formation testing on one or more fluids received from one or more zones of interest of a subterranean formation, wherein the downhole toolstring comprises a single packer positioned near a lower end of the downhole toolstring, and wherein the single packer is configured to be set within a wellbore extending through the subterranean formation to isolate the one or more zones of interest of the subterranean formation in a lower portion of the wellbore below the single packer from an upper portion of the wellbore above the single packer;

a first downhole barrier configured to be deployed and set within the wellbore at a first downhole location below the downhole toolstring and the single packer prior to setting the single packer within the wellbore; and a second downhole barrier configured to be deployed and set within the wellbore at a second downhole location above the first downhole barrier and below the downhole toolstring and the single packer prior to setting the single packer within the wellbore.

10. The downhole formation testing system of claim 9, wherein the first downhole barrier comprises a retrievable bridge plug.

11. The downhole formation testing system of claim 9, wherein the downhole toolstring is configured to:

perform downhole formation testing on a first fluid received from a first zone of interest by the downhole toolstring in a first interval of the wellbore between the first downhole barrier and the second downhole barrier; and perform downhole formation testing on a second fluid received from a second zone of interest by the downhole toolstring in a second interval of the wellbore between the second downhole barrier and the single packer.

12. The downhole formation testing system of claim 11, wherein the second downhole barrier comprises a bore extending axially therethrough to enable flow of the first and second fluids between the first and second intervals of the wellbore.

13. The downhole formation testing system of claim 12, wherein the second downhole barrier comprises one or more sensors configured to determine at least one of flow or volume rates of the first and second fluids, and wherein the downhole toolstring is configured to perform downhole formation testing on the first and second fluids based at least in part on the at least one of flow or volume rates of the first and second fluids.

14. The downhole formation testing system of claim 13, wherein the one or more sensors comprise:

an upper sensor positioned on an upper side of the second downhole barrier; and a lower sensor positioned on a lower side of the second downhole barrier.

15. The downhole formation testing system of claim 9, wherein the first and second downhole barriers comprise retrievable bridge plugs.

16. A method, comprising:

deploying and setting a first downhole barrier of a downhole formation testing system within a wellbore at a first downhole location extending through a subterranean formation;

deploying and setting a second downhole barrier of the downhole formation testing system within the wellbore at a second downhole location above the first downhole barrier, wherein the second downhole barrier comprises:

a bore extending axially therethrough to enable fluids to flow therethrough;

an upper sensor positioned on an upper side of the second downhole barrier; and a lower sensor positioned on a lower side of the second downhole barrier;

deploying a downhole toolstring of a downhole formation testing system to a third downhole location within the wellbore above the first and second downhole barriers, wherein the downhole toolstring comprises a single packer positioned near a lower end of the downhole toolstring;

setting the single packer within the wellbore to isolate first and second zones of interest of the subterranean formation in a lower portion of the wellbore below the single packer from an upper portion of the wellbore above the single packer; and after setting the single packer within the wellbore:

using the downhole toolstring to perform downhole formation testing on a first fluid received from a first zone of interest by the downhole toolstring in a first interval of the wellbore between the first downhole barrier and the second downhole barrier based at least in part on at least one of flow or volume rates of the first and second fluids detected by the upper and lower sensors of the second downhole barrier; and using the downhole toolstring to perform downhole formation testing on a second fluid received from a second zone of interest by the downhole toolstring in a second interval of the wellbore between the second downhole barrier and the single packer based at least in part on the at least one of flow or volume rates of the first and second fluids detected by the upper and lower sensors of the second downhole barrier.

* * * * *